US006880924B2

(12) United States Patent
Sesek et al.

(10) Patent No.: US 6,880,924 B2
(45) Date of Patent: Apr. 19, 2005

(54) IMAGING MEDIA CARTRIDGE HAVING A RESERVE CHAMBER

(75) Inventors: Robert Sesek, Meridian, ID (US); Travis J. Parry, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/644,481

(22) Filed: Aug. 20, 2003

(65) Prior Publication Data

US 2004/0036750 A1 Feb. 26, 2004

Related U.S. Application Data

(63) Continuation of application No. 10/076,804, filed on Feb. 16, 2002, now Pat. No. 6,679,594.

(51) Int. Cl.[7] ..... B41J 2/175; G03G 15/04; G03G 15/08

(52) U.S. Cl. ..... 347/86; 399/219; 399/262

(58) Field of Search ..... 347/86, 87; 339/103, 339/111, 118, 119, 259, 260, 262

(56) References Cited

U.S. PATENT DOCUMENTS

| | | | | | |
|---|---|---|---|---|---|
| 4,607,938 | A | * | 8/1986 | Hosoi et al. | 399/259 |
| 4,615,608 | A | * | 10/1986 | Mizutani | 399/103 |
| 5,028,961 | A | * | 7/1991 | DeCecca | 399/119 |
| 5,249,020 | A | * | 9/1993 | Takano | 399/260 |
| 5,383,009 | A | * | 1/1995 | Tsusaka | 399/111 |
| 6,679,594 | B1 | * | 1/2004 | Sesek et al. | 347/86 |

* cited by examiner

*Primary Examiner*—Anh T.N. Vo

(57) ABSTRACT

An imaging media cartridge for use in an imaging apparatus includes a first imaging media reservoir chamber and a second imaging media reservoir chamber. A removable barrier is disposed between the first imaging media reservoir chamber and the second imaging media reservoir chamber. By removing the removable barrier, a reserve of imaging media can be provided from the second imaging media reservoir chamber to the first imaging media reservoir chamber. In one embodiment the imaging media cartridge is a toner cartridge. In another embodiment the imaging media cartridge is a liquid ink cartridge.

22 Claims, 8 Drawing Sheets

IMAGING MEDIA CARTRIDGE HAVING A RESERVE CHAMBER

CROSS REFERENCE TO RELATED APPLICATIONS

This application is a continuation application under 35 U.S.C. § 120 of U.S. patent application Ser. No. 10/076,804, filed Feb. 16, 2002, now U.S. Pat. No. 6,679,594 which is hereby incorporated by reference herein in its entirety.

FIELD OF THE INVENTION

The invention claimed and disclosed herein pertains to cartridges for containing imaging media (such as ink and toner) used by imaging apparatus to generate an image.

BACKGROUND OF THE INVENTION

The present invention pertains to what is commonly known as "printer cartridges". These cartridges may better be termed "imaging media cartridges" since they are configured to contain an imaging media, such as an ink or a toner. In order to facilitate handling of the imaging media by a user of the imaging apparatus, the imaging media is commonly provided within a container (a "cartridge") that is configured to be installed in, and removed from, the imaging apparatus. The cartridge is typically designed to prevent leakage of the imaging media from the cartridge when the cartridge is handled by a user or installed in the device, but is also designed to allow the imaging apparatus to selectively remove the imaging media from the cartridge during an imaging process.

By "imaging apparatus" we mean any apparatus configured to use imaging media to generate an image on sheet media, such as on paper or a transparency. Examples of imaging apparatus include (without limitation) printers, photocopies, facsimile machines, plotters, and combinations thereof (i.e., imaging apparatus commonly known as "all-in-one" imaging apparatus or "multifunction peripherals"). Example of imaging processes that can be used by imaging apparatus include electrophotographic imaging, including laser printing, and ink printing, including ink jet printing. Two primary types of imaging media are provided to imaging apparatus via a cartridge. These primary types of imaging media include wet ink and dry toner. Dry toner ("toner") is commonly provided as powdered carbon black or very small particles of plastic (as in the case of non-black toners).

When the imaging media within a cartridge becomes depleted, the user typically replaces the spent cartridge with a replacement cartridge that contains additional imaging media. The user may not always have a replacement cartridge on hand, or the replacement cartridge may not be easily accessible. Accordingly, a user may be put in the position of not being able to complete an imaging job due to a lack of imaging media.

Some imaging apparatus are provided with imaging media quantity detectors which allow a user to have advance notice of a low imaging media condition, and thus take appropriate steps to secure a replacement cartridge. For example, the imaging media quantity detector can be a level detector to detect a level of toner or ink in an imaging cartridge. However, such quantity detectors are not found in all imaging apparatus, and typically are not included in relatively inexpensive imaging apparatus. Further, such imaging media quantity detectors are not always accurate. Another prior art method for detecting impending depletion of imaging media in a cartridge is using a so-called "pixel counter". The pixel counter essentially comprises an algorithm which is executed by a processor in the imaging apparatus and which calculates (estimates) the usage of imaging media based on the number of pixels imaged by the imaging apparatus since the time the current imaging media cartridge was installed. However, such pixel counters are not always accurate, with obvious undesirable consequences (specifically, the imaging media in the cartridge becomes exhausted before the pixel counter indicates it should be exhausted).

With respect to certain dry toner cartridges, a user may notice fading of the image on imaged sheets of media, indicating a pending toner depletion condition. In the absence of an accurate imaging media quantity detector, this fading will most likely be the first indication that the user receives indicating a pending toner exhaustion condition. In certain instances the user may be able to extend the life of the toner cartridge by rocking it back-and-forth a number of times to redistribute the remaining toner within the cartridge. This may allow approximately 30 to 40 additional pages to be imaged using the toner cartridge before the cartridge is depleted of toner. In some cases this will provide the user with sufficient additional imaging capacity to allow the user time obtain a replacement cartridge, and more specifically, to allow the user to complete the current imaging job before replacing the cartridge. However, toner cartridges are now more commonly designed as "no-shake" cartridges, which incorporate baffles and/or an agitator within the toner cartridge to more evenly distribute toner within the cartridge, and thus reduce the fading which is manifested before depletion of the toner in earlier cartridge designs. Such "no-shake" cartridges only provide a user with approximately 5 to 10 pages of remaining imaging capacity after the first signs of toner depletion appear. In this case it will frequently occur that a user will not be able to complete a printing job without replacing the cartridge. If a replacement cartridge is not readily at-hand, then the user will need to interrupt the imaging job and continue it later once a replacement cartridge has been installed in the imaging apparatus.

When the imaging media cartridge contains liquid ink, and in the absence of an accurate imaging media quantity detector, the first indication the user may receive that the cartridge is in need of replacement is when the ink is exhausted from the cartridge. Thus, unlike the situation with toner cartridges, with ink cartridges the user must interrupt an imaging job upon the first indication of cartridge depletion, unless a replacement cartridge is readily at-hand.

What is needed then is a way to reduce the effects which result from depletion of prior art imaging media cartridges.

SUMMARY OF THE INVENTION

An imaging media cartridge for use in an imaging apparatus includes a first imaging media reservoir chamber and a second imaging media reservoir chamber. A removable barrier is disposed between the first chamber and the second chamber. By removing the barrier, a reserve of imaging media can be provided from the second chamber to the first chamber. In one embodiment the imaging media cartridge is a toner cartridge. In another embodiment the imaging media cartridge is a liquid ink cartridge.

These and other aspects and embodiments of the present invention will now be described in detail with reference to the accompanying drawings, wherein:

DETAILED DESCRIPTION OF THE INVENTION

The present invention pertains to imaging media cartridges for use in imaging apparatus. We have described above what we mean by the terms "imaging apparatus", "imaging media", and "imaging media cartridge", which will be used in the following description of the present invention. The present invention addresses the problems associated with prior art imaging media cartridges (as described above) by providing, within the imaging media cartridge, an auxiliary (or reserve) reservoir of imaging media. This auxiliary reservoir of imaging media can be accessed by a user once the user becomes aware that the primary reservoir of imaging media is about to become depleted. In this way the useful life of the cartridge can be extended, allowing the user an opportunity to complete any in-progress imaging jobs, and further providing the user a limited period of time during which the user can secure a replacement cartridge. The present invention is particularly useful for imaging media cartridges such as toner cartridges (for use in laser imaging apparatus) and wet ink cartridges (for use in ink jet imaging apparatus).

We will now describe specific examples of the present invention with respect to the accompanying drawings. However, it is understood that the drawings depict only examples of the invention, and should therefore not be understood as limiting the scope of the invention, which is described below and set forth in the claims.

Figure 1:
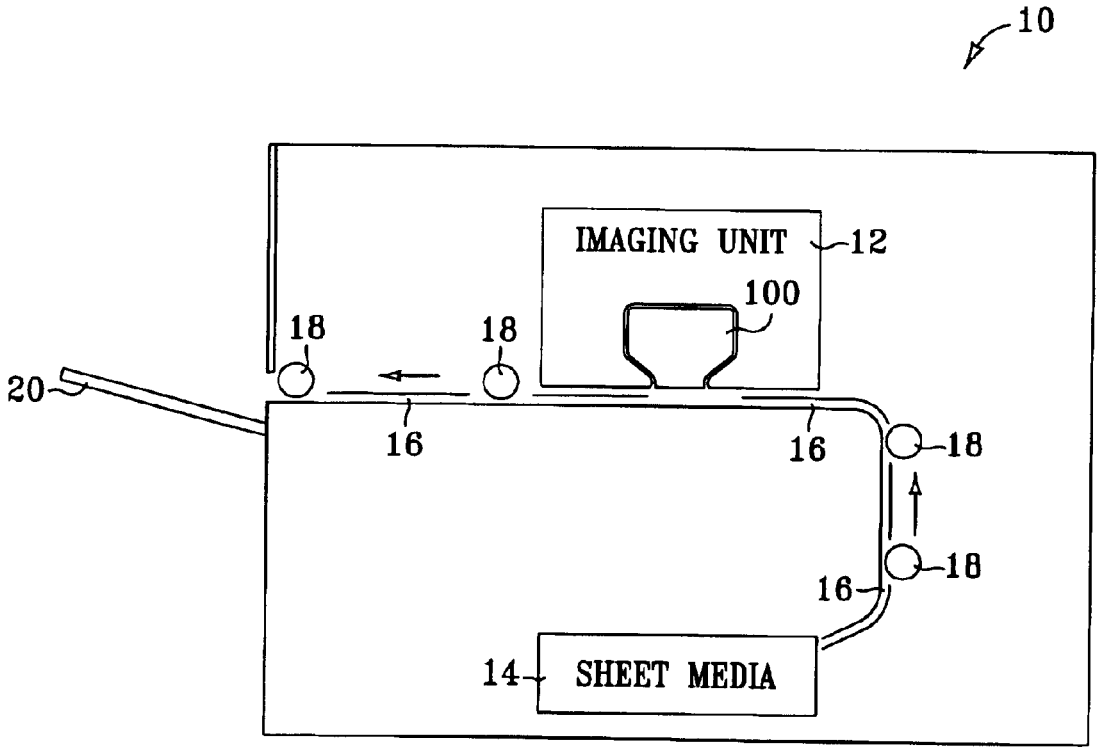
FIG. 1 is a front elevation schematic depicting an imaging apparatus using a toner cartridge.

Turning to FIG. 1, an imaging apparatus 10 is depicted in a front elevation diagram. The imaging apparatus 10 is depicted in a simplified manner and is shown primarily for purposes of setting forth the environment in which imaging media cartridges of the present invention are used. The imaging apparatus 10 can be an electrophotographic imaging apparatus (such as a laser printer or a laser copier) which moves sheet media 14 along a media path 16 using powered rollers 18. As the sheet media is moved past the imaging unit 12, an imaging media, such as a toner, is deposited from the imaging media cartridge ("cartridge") 100 onto the sheet media. The deposition of imaging media from the cartridge 100 onto the sheet media can be direct, or it can be indirect through the use of an intermediate transfer unit, such as a transfer belt or a transfer drum. The imaged sheet media is then deposited in the output tray 20. In the configuration depicted, the cartridge 100 can be removed from the imaging unit 12 by moving the cartridge out of the plane of the sheet on which the figure is drawn.

Figure 2:
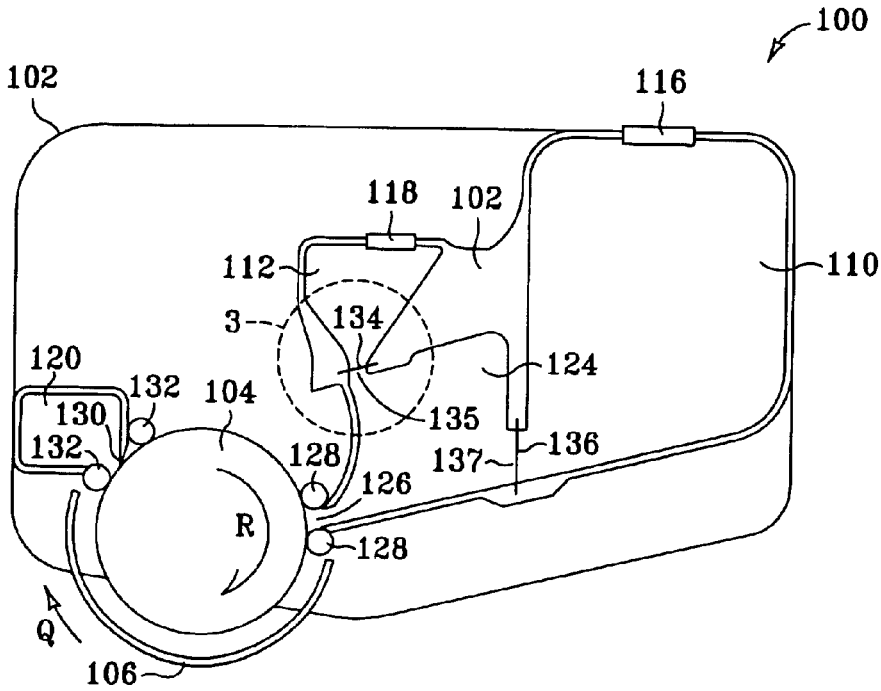
FIG. 2 is a side elevation view depicting a toner cartridge having a reserve supply of toner.

For purposes of the following discussion, let us assume that the imaging apparatus 10 is a laser imaging apparatus, and the cartridge 100 is a toner cartridge. (We will later describe an embodiment of the present invention wherein the cartridge is a wet ink cartridge.) Turning to FIG. 2, a side elevation sectional view of the toner cartridge 100 of FIG. 1 is shown in detail. The cartridge 100 has a body 102, which is typically fabricated from one or more plastic components and which supports other components within the cartridge, and also defines imaging media chambers. Specifically, the cartridge 100 includes a first, or primary, imaging media reservoir chamber 110. The primary chamber 110 is used to contain the bulk of the imaging media which will be dispensed from the cartridge and used by the imaging apparatus (10, FIG. 1). The primary chamber 110 is filled with imaging media (at a manufacturing location, for example) through a fill hole, which is then plugged with a fill plug 116. The cartridge 100 further includes an imaging media (toner) distribution device 104, which is shown here as an optical photoconductor, or "OPC". The OPC 104 is used to extract imaging media (toner) from the cartridge 100 so that it can be applied to sheet media, as will be explained more fully below. Located between the primary chamber 110 and the OPC 104 is a distribution chamber 124. A first removable barrier 136 is disposed in a passageway 137 defined between the primary chamber 110 and the distribution chamber 124.

Figure 4:
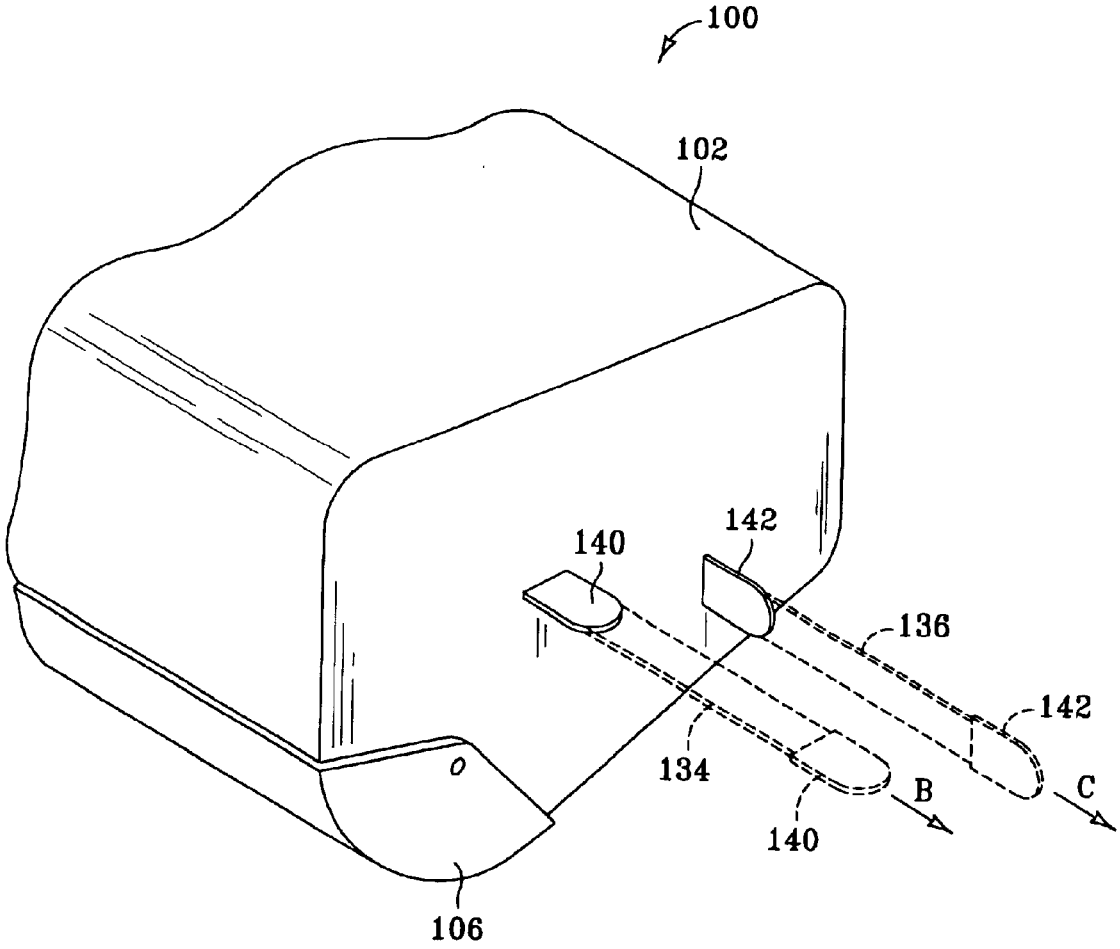
FIG. 4 is an isometric view of a portion of the toner cartridge of FIG. 2.

Turning briefly to FIG. 4, a partial isometric diagram of the toner cartridge 100 of FIG. 2 is shown. Pull-tab 142 is attached to the removable barrier 136, which can be a flexible strip of tape. When a user pulls the tab 142 in direction "C", the removable barrier 136 is pulled out of the cartridge 100. Returning to FIG. 2, it can be seen that by removing the removable barrier 136, imaging media (toner) can flow from the primary reservoir chamber 110 into the distribution chamber 124. Once in the distribution chamber 124, toner can flow into the outlet channel 126 where it contacts the OPC 104. Seals 128 prevent the toner from flowing out of the distribution chamber. A moveable cover 106 protects the OPC 104 when the cartridge 100 is removed from an imaging apparatus, but when the cartridge 100 is installed in an imaging apparatus, the cover 106 moves in direction "Q" to uncover the OPC 104. When the OPC is uncovered, it can be electrographically exposed using a pulsed laser or light emitting diodes (not shown). As the OPC rotates in direction "R", the exposed portions of the OPC will move to the outlet channel 126, where toner will be attracted to, and adhere to, the exposed areas of the OPC 104. In this way toner is extracted from the distribution chamber 124 of the cartridge 100. The cartridge 100 also includes a cleaning station which includes a waste chamber 120, a doctor blade 130 for scraping residual toner off of the OPC (i.e., toner which has not been transferred from the OPC to sheet media or to an intermediate transfer media). Seals 132 prevent toner in the waste chamber 120 from migrating out of the waste chamber.

Figure 3:
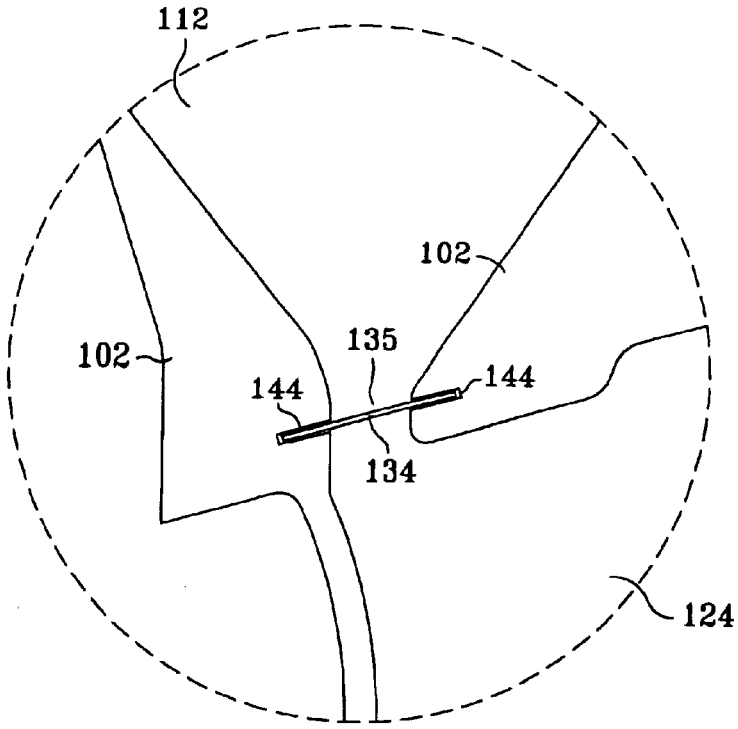
FIG. 3 is a side elevation detail diagram depicting a segment of the toner cartridge of FIG. 2.

The cartridge 100 of FIG. 2 further includes a second imaging media reservoir chamber 112, which we will call the "reserve chamber" or "auxiliary media chamber". The reserve chamber 112 is configured to contain a smaller portion of imaging media than is initially contained in the primary reservoir chamber 110. The reserve chamber 112 is filled with imaging media (at a manufacturing location, for example) through a fill hole, which is then plugged with a fill plug 118. The reserve chamber 112 is located proximate the distribution chamber 124, and is isolated from the distribution chamber by a second removable barrier 134. FIG. 3 depicts a detail of the area between the reserve chamber 112 and the distribution chamber 124, showing how the removable barrier 134 can be positioned in the passageway 135 which connects the chambers 112 and 124. Preferably, the removable barrier fits within slots 144 formed in the body 102 of the cartridge 100 so that toner will not migrate from the reserve chamber 112 into the distribution chamber 124 while the removable barrier 134 is in place. Turning briefly to FIG. 4, a second pull-tab 140 is attached to the second removable barrier 134, which can also be a strip of flexible tape. When a user pulls the tab 140 in direction "B", the removable barrier 134 is pulled out of the cartridge 100. Returning to FIG. 2, it can be seen that by removing the second removable barrier 134, imaging media (toner) can flow from the second reservoir chamber 112 (the reserve chamber) into the distribution chamber 124. Accordingly, when a user first notices toner fade on the imaged sheet media (indicating pending depletion of toner from the distribution chamber 124, as well as from the primary chamber 110), then the user can remove the cartridge 100 from the imaging apparatus to access the pull-tab 140 (FIG. 4). The user can then pull the second tape strip 134 out of the cartridge body 102 using tab 140, thereby providing a reserve of toner to the distribution chamber 124. The cartridge 100 can then be reinstalled in the imaging apparatus, and the user can continue to generate images using the cartridge 100. Preferably, the volume of the reserve chamber 124 is about ten percent or less of the volume of the primary chamber 110. This will provide the user with sufficient imaging media to complete most imaging jobs currently being processed, and will also provide the user with a period of time during which the user can secure a replacement cartridge.

It is understood that the primary chamber 110 and the reserve (or "auxiliary") chamber 112 are distinguished from the distribution chamber 124 in that the primary and reserve chambers are configured to be filled with toner at the point of manufacture, whereas the distribution chamber is only filled with toner when the user places the toner cartridge in service.

Figure 5:
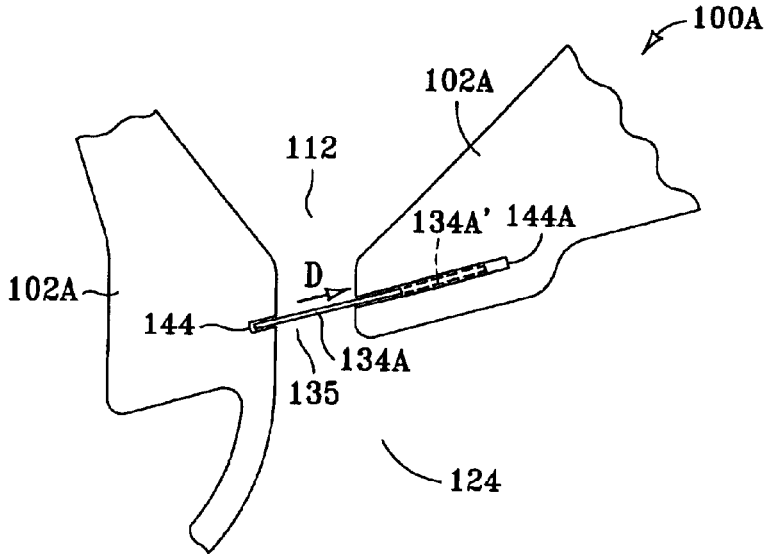
FIG. 5 is a side elevation detail diagram depicting a variation of a segment of the toner cartridge of FIG. 2.
Figure 7:
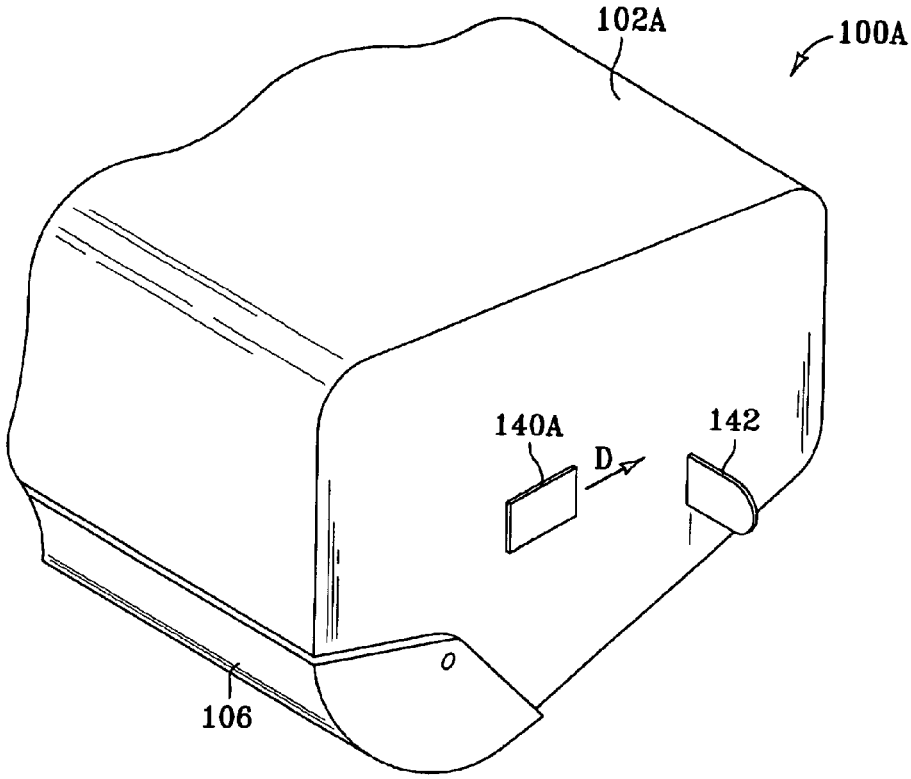
FIG. 7 an isometric view of a portion of a toner cartridge incorporating the variation depicted in FIG. 5.

Turning to FIG. 5, a variation on the configuration depicted in FIG. 3 is shown. FIG. 5 depicts a detail of the area of a cartridge 100A between the reserve chamber 112 and the distribution chamber 124, similar to the depiction shown in FIG. 3. However, whereas the second removable barrier 134 of FIG. 3 was in the form of a strip of flexible tape (see also FIG. 4), in FIG. 5 the removable barrier 134A comprises a rigid member positioned within slots 144 and 144A which are formed in the body 102A of the cartridge 100A. In a first position (indicated by the solid lines representing barrier 134A), the right edge of the barrier 134A only partially fills the right slot 144A. In a second position, (indicated by the dashed lines representing barrier 134A), the right edge of the barrier 134A has moved in direction "D" to substantially fill the right slot 144A. In this position, the left edge of the barrier 134A will move out of the left slot 144, and the reserve quantity of toner will be free to migrate from the reserve chamber 112 into the distribution chamber 124. Turning to FIG. 7, a partial isometric diagram of the toner cartridge 100A of FIG. 5 is depicted. A thumb-switch 140A, which is connected to the removable barrier 134A of FIG. 5, is positioned on the outer surface of the cartridge body 102A. By moving the thumb-switch 140A in direction "D", the removable barrier 134A (FIG. 5) moves in direction "D" (as indicated in FIG. 5), allowing the reserve quantity of toner to move into the distribution chamber (124, FIG. 5). The thumb-switch 140A (FIG. 7), or the removable barrier 134A (FIG. 5) can be lightly secured to the body 102A of the cartridge 100A so that a certain amount of force is required to move the thumb-switch in direction "D", thus reducing the likelihood of premature deployment of the thumb-switch 140A.

Figure 6:
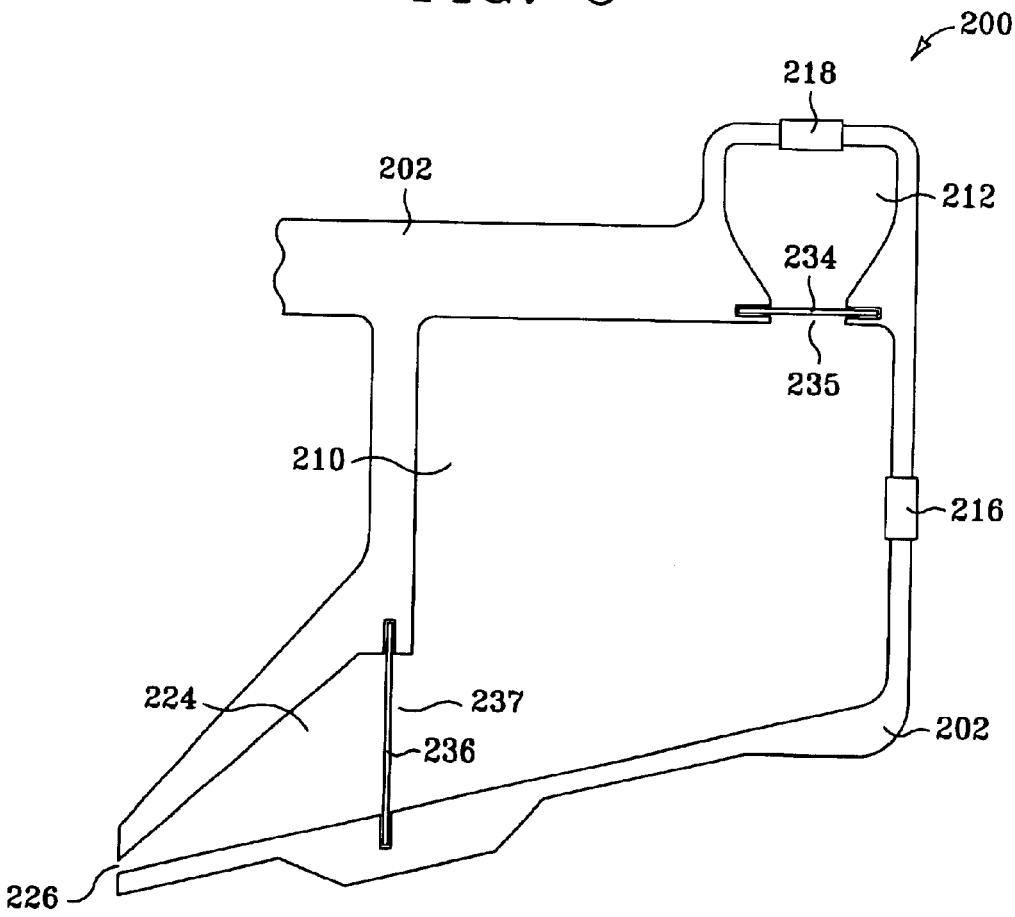
FIG. 6 is a side elevation detail diagram depicting another variation of a segment of the toner cartridge of FIG. 2.

Turning now to FIG. 6, a second variation of a toner cartridge 200 in accordance with the present invention is depicted in a simplified side elevation view. Certain components of the toner cartridge 200 are not shown for the sake of simplicity, but it will be understood that the cartridge 200 can contain an OPC similar to OPC 104 of FIG. 2, as well as a cleaning station (waste chamber 120, doctor blade 130, seals 132, etc., FIG. 2). Toner cartridge 200 (FIG. 6) differs from toner cartridge 100 (FIG. 2) in the following primary aspect. In toner cartridge 100, the reserve chamber 112 (the second imaging media reservoir chamber) is configured to release the reserve supply of toner into the distribution chamber 124 when the second barrier 134 is removed, whereas in toner cartridge 200 the reserve chamber 212 (the second imaging media reservoir chamber) is configured to release the reserve supply of toner into the primary reservoir chamber 210 (the "first imaging media reservoir chamber") when the second removable barrier 234 is removed from the position depicted in FIG. 6.

More specifically, toner cartridge 200 of FIG. 6 includes cartridge body 202, which defines a first, or primary, imaging media (toner) reservoir chamber 210. Primary chamber 210 can be filled with toner via a fill hole, which is then plugged with plug 216. The cartridge body 202 further defines a second imaging media reservoir chamber 212 (the reserve chamber) which can be placed in communication with primary chamber 210 via passageway 235. The reserve chamber 212 can also be filled with toner via a fill hole, which is thereafter plugged with plug 218. As depicted, the cartridge body 202 also defines a distribution chamber 224, which is not initially filled with imaging media, and which includes an outlet channel 226. Passageway 237 allows imaging media (toner) to move from the primary reservoir chamber 210 into the distribution chamber 224. The outlet channel 226 allows imaging media to contact a distribution device (not shown), such as an optical photoconductor (OPC) similar to OPC 104 of FIG. 2. A first removable barrier 236 (such as the flexible tape strip 136 of FIGS. 2 and 4) is disposed within the passageway 237 to isolate the toner in the primary chamber 210 from the distribution chamber 224 until a user places the cartridge in service. Likewise, a second removable barrier 234 (such as the flexible tape strip 134 of FIGS. 2 and 4) is disposed within the passageway 235 to isolate the toner in the reserve reservoir chamber 212 from the primary chamber 210.

When a user detects that the supply of toner from the primary chamber 210 is nearing depletion (as for example, by fading on imaged sheet media), then the user can remove the cartridge 200 from the imaging apparatus, and can remove the second removable barrier 234, thereby allowing the reserve supply of toner from the reserve chamber 212 to move into the primary chamber 210, and from there to the distribution chamber 224.

It is understood that the toner cartridges 100, 100A, and 200 of FIGS. 2 through 7 are exemplary only, and that other toner cartridges within the scope of the present invention can also be provided. For example, the removable barriers 134 and 234, which temporarily isolate the reserve chambers (respectively, chambers 112 and 212) can be a hinged "door" that can be operated via a lever placed on the outer surface of the cartridge (similar to the thumb-switch 140A of FIG. 7). Further, the imaging media cartridge does not necessarily include a distribution device (OPC 104, FIG. 2), in which case the distribution chamber (124, FIG. 2, 224, FIG. 6) is not required. However, when no distribution chamber is provided, then the cartridge preferably is arranged as depicted in FIG. 6, such that the reserve chamber 212 is connected to (or communicates directly with (or can be connected to)) the primary chamber 210. In another variation, the cartridge can be a refillable cartridge. That is, cartridge 100 (FIG. 2) and cartridge 200 (FIG. 6) are depicted as being factory-sealed (via plugs 116 and 118 (FIG. 2) and plugs 216 and 218 (FIG. 6)) after toner has been initially provided to the primary chambers (110, FIG. 2, and 210, FIG. 6) and the reserve chambers (112, FIG. 2, and 212, FIG. 6). However, some cartridges are configured to be refilled from a separate bulk supply container of imaging media so that the user does not need to recycle the cartridge after the toner within the cartridge is depleted. In this case, after the user has depleted the primary chamber, as well as the reserve chamber, the user can refill both the primary and the reserve chambers from the separate bulk container. This allows a user to complete an imaging job without having to stop to recharge the cartridge with imaging media.

Figure 8:
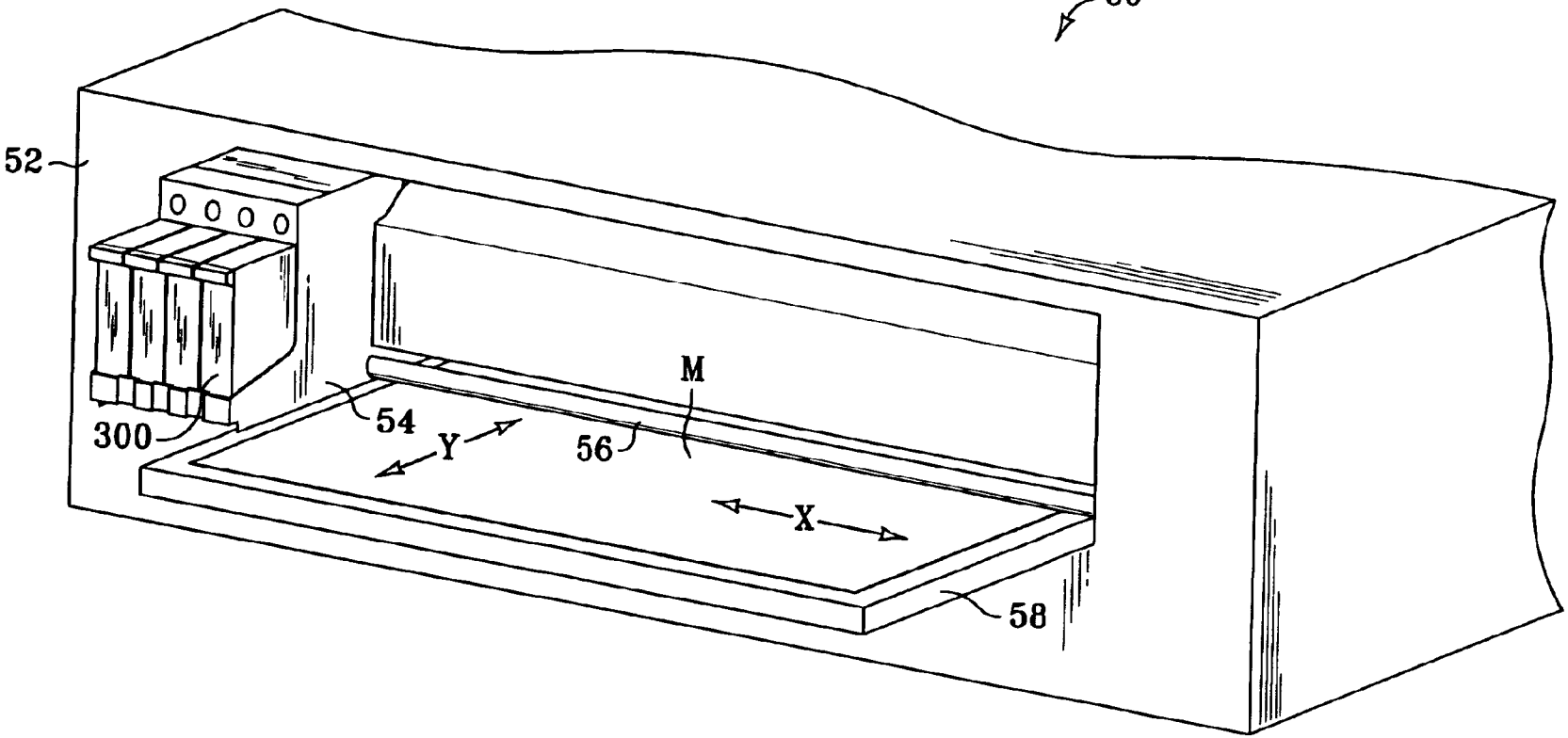
FIG. 8 is an isometric diagram depicting an imaging apparatus using an ink cartridge.

We will now describe an embodiment of the present invention wherein the imaging media cartridge having a reserve supply of imaging media is an ink cartridge. Turning to FIG. 8, a second type of imaging apparatus is depicted in a partial isometric view. The imaging apparatus 50 of FIG. 8 is an ink-type imaging apparatus, and specifically is depicted as being a four-color ink jet imaging apparatus. The imaging apparatus 50 includes a main body 52, which supports a sheet media tray 58. Sheet media "M" is moved past the sheet media tray 58 in direction "Y". A cartridge cradle 54 supports a plurality of removable ink cartridges 300. Each ink cartridge contains wet ink ("ink") which can be used to generate an image on sheet media. The cartridge cradle 54 is configured to move along rail 56 in the "X" direction to thereby move the ink cartridges 300 past the sheet media "M", allowing ink from the ink cartridges 300 to be deposited on the sheet media "M" and thus form an image on the sheet media.

Figure 9:
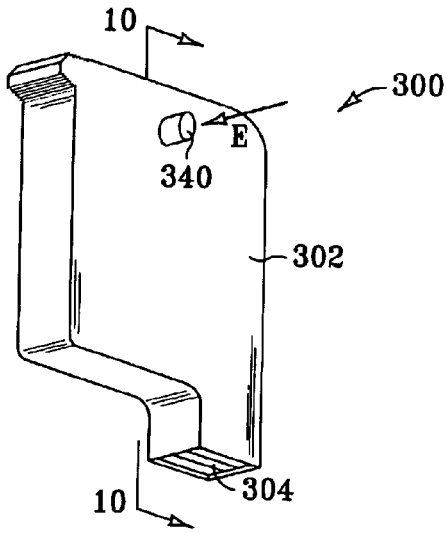
FIG. 9 is an isometric diagram depicting an ink cartridge in accordance with the present invention.

Turning to FIG. 9, an isometric diagram of one ink cartridge 300 of FIG. 8 is depicted. The ink cartridge 300 has a cartridge body 302 and also supports a print head 304. The print head 304 may more broadly be termed a "media (or ink) distribution device", since its purpose is to distribute imaging media (ink) from the ink cartridge onto sheet media. It is understood that the ink cartridge does not need to include the print head 304, and that many ink cartridges are configured to be stationary within the imaging apparatus (unlike the configuration depicted in FIG. 8). When the ink cartridge is stationary, then a moveable print head is provided which includes a distribution reservoir. In this case, the moveable print head moves periodically to the ink cartridge to allow the distribution reservoir to be refilled from the ink cartridge. However, this configuration suffers from the same prior art drawbacks as described above. That is, the ink cartridge can become depleted with little or no advance warning to the user. The ink cartridge 300 of FIG. 9 includes a first, or primary, imaging media reservoir chamber (not shown in FIG. 9), as well as a second, reserve, imaging media reservoir chamber (also not shown in FIG. 9). A button 340 allows ink from the reserve chamber to be drained into the primary chamber, as will be described in detail below.

Figure 10:
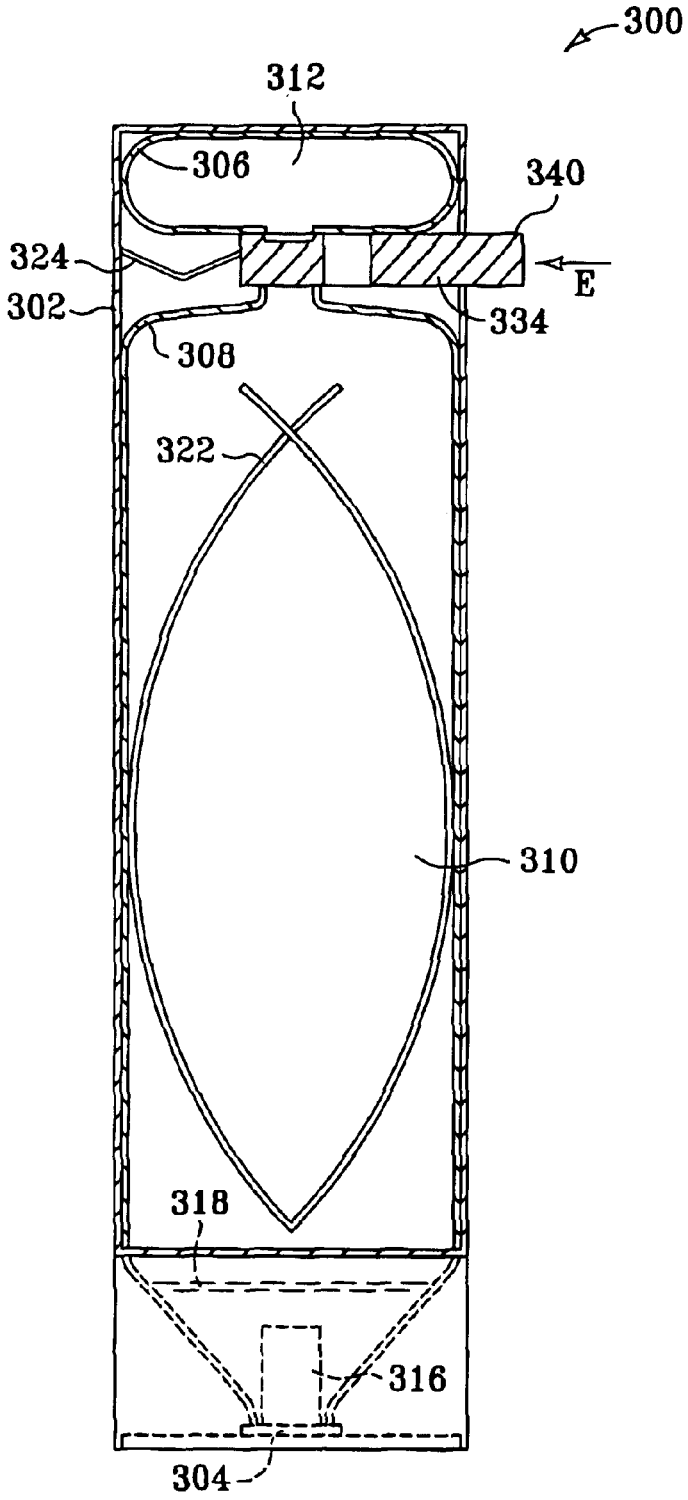
FIG. 10 is a front elevation sectional diagram of the ink cartridge depicted in FIG. 9.

Turning now to FIG. 10, a front elevation sectional view of the ink cartridge 300 of FIG. 9 is depicted. The ink cartridge 300 includes an ink cartridge body 302, which can be fabricated from injection molded plastic components. Positioned within the ink cartridge body 302 is a first bladder 308 which defines a first (primary) imaging media reservoir chamber 310. The primary chamber 310 is configured to contain liquid ink. A membrane 318 is positioned within the lower portion of the first bladder 308, and allows ink to pass from the primary reservoir 310 into a standpipe 316, which is in fluid communication with the print head 304. As ink within the primary chamber 310 is drawn out of the first bladder 308, and in the absence of an air vent, the bladder 308 will tend to collapse under atmospheric pressure. In order to prevent the atmospheric pressure on the bladder 308 from forcing ink from the bladder via the print head 304, a spring unit 322 tends to push the walls of the bladder outward, thus resisting the atmospheric pressure on the outer surface of the bladder 308.

Figure 11:
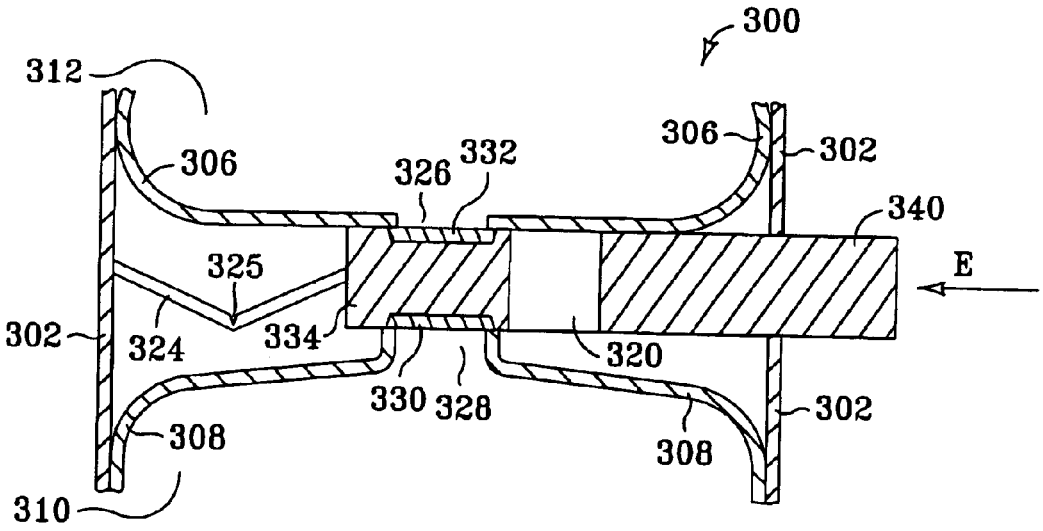
FIG. 11 is a front elevation detail diagram of the ink cartridge depicted in FIG. 10.

The ink cartridge 300 further includes a second bladder 306 which defines a second (reserve) imaging media reservoir chamber 312. Disposed between openings in the first bladder 308 and the second bladder 306 is a removable barrier 334. Turning to FIG. 11, a detail diagram of the upper portion of the ink cartridge 300 is depicted. As can be seen, the first bladder 308, which defines the primary chamber 310, includes an opening 328. Likewise, the second bladder 306, which defines the reserve chamber 312, includes an opening 326. The removable barrier 334 is disposed between the bladder openings 326 and 328. Seal 332 in the removable barrier 334 prevents ink from flowing out of the reserve chamber 312, while seal 330 in the removable barrier 334 resists the intrusion of air into the primary chamber 310. The removable barrier 334 is held in the position indicated by a compliant member 324, which can be a made of plastic. The compliant member 324 thus resists unintentional movement of the removable barrier 334. The compliant member 324 has a buckling initiating crease 325, such that when a user presses on the "button" 340 (i.e., the right end of removable barrier 334) in direction E, the compliant member will buckle about the buckling crease 325, allowing the removable barrier 334 to move leftward (with respect to the orientation shown in FIG. 11). When the removable barrier 334 moves leftward (as a result of a user pressing on the "button" portion 340 of the removable barrier 334 in direction E), a port 320 in the removable barrier moves into a position between the openings 326 and 328 in the respective second bladder 306 and the first bladder 308. When this occurs, ink from the reserve chamber 312 can flow into the primary chamber 310. Accordingly, when a user detects that the ink in the primary chamber 310 is depleted, or near depletion, the user can press the "button" 340, causing the ink in the reserve chamber 312 to flow into the primary chamber 310. This will provide the ink cartridge 300 with an auxiliary supply of ink, which will provide the user an opportunity to complete an in-progress imaging job, and/or provide the user a period of time in which to retrieve a replacement ink cartridge.

Figure 12:
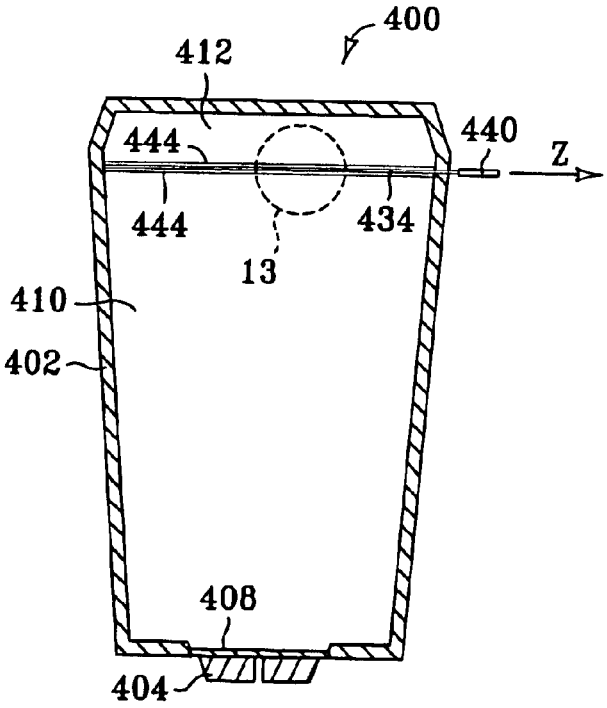
FIG. 12 is a front elevation, sectional view depicting another ink cartridge in accordance with the present invention.
Figure 13:
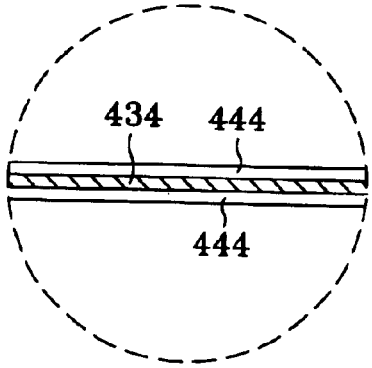
FIG. 13 is a side elevation detail taken from FIG. 12.

Turning now to FIG. 12, a side elevation sectional view of an alternate ink cartridge 400 in accordance with the present invention is depicted. The primary difference between the ink cartridge 400 of FIG. 12 and the ink cartridge 300 of FIG. 10 is that the ink cartridge 300 includes bladders 306 and 308 which define the ink reservoir chambers 312 and 310, whereas the ink cartridge 400 does not have a bladder, and the ink reservoir chambers are defined by the body of the cartridge. More specifically, the ink cartridge 400 has a body 402 which can be made from injection molded plastic or the like. The ink cartridge body 402 defines a first, primary, imaging media reservoir chamber 410, as well as a second, reserve, imaging media reservoir chamber 412. The reserve chamber 412 is isolated from the primary chamber 410 by the removable barrier 434. As can be seen in the enlarged detail section FIG. 13, the removable barrier 434 is supported between two channel sections 444 which are located on opposite sides of the interior of the ink cartridge body 402. The removable barrier 434 can include a pull-tab 440 which protrudes from one side of the ink cartridge 400. A user can grasp the tab 440 and pull it in direction "Z", to remove the removable barrier from the ink cartridge, thereby allowing ink in the reserve chamber 412 to flow into the primary chamber 410. The removable barrier can be a flexible material, such as Mylar® film, available from E. I. du Pont de Nemours and Company. As shown, the ink cartridge 400 includes an imaging media (ink) distribution device comprising a print head 404. A membrane 408 prevents ink from leaking out of the primary chamber 410.

In another embodiment the present invention provides for a method of manufacturing an imaging media cartridge. The method includes providing a first imaging media reservoir chamber (such as primary chamber 110 of FIG. 2, 210 of FIG. 6, 310 of FIG. 10, or 410 of FIG. 12), and depositing in the first imaging media chamber a first volume of an imaging media. The imaging media can be, for example, a dry toner or a liquid ink. The method further includes providing a second imaging media reservoir chamber (such as reserve chamber 112 of FIG. 2, 212 of FIG. 6, 312 of FIG. 10, or 412 of FIG. 12), and depositing in the second imaging media chamber a second volume of the imaging media. A removable barrier (such as removable barrier 134 of FIG. 2, 134A of FIG. 5, or 234 of FIG. 6, 334 of FIG. 10, or 434 of FIG. 12) is then provided between the first imaging media chamber and the second imaging media chamber.

When the removable barrier is a second removable barrier (such as barriers 134 of FIG. 2, 134A of FIG. 5, and 234 of FIG. 6), then the method can further include providing an imaging media distribution device (such as OPC 104 of FIG. 2), and providing a distribution chamber (such as distribution chamber 124 of FIG. 2, or 224 of FIG. 6) which is in contact with the imaging media distribution device. A first removable barrier (such as barrier 136 of FIG. 2, or 236 of FIG. 6) is provided between the first imaging media chamber (for example, primary chamber 110 of FIG. 2, or 210 of FIG. 6) and the distribution chamber. In this instance, the distribution chamber is left void of imaging media. Once a user removes the first removable barrier that has been placed between the primary chamber and the distribution chamber, the imaging media can flow from the primary chamber into the distribution chamber.

Alternately, the method can include providing a distribution chamber (such as distribution chamber 124 of FIG. 2), and disposing the distribution chamber between the first imaging media chamber (such as primary chamber 110 of FIG. 2) and the second imaging media chamber (such as reserve chamber 110 of FIG. 2). In this case, the removable barrier (e.g., barrier 134 of FIG. 2) becomes a second removable barrier and separates the reserve chamber (112, FIG. 2) from the distribution chamber (124, FIG. 2). The method then further includes providing a first removable barrier (such as barrier 136 of FIG. 2) between the distribution chamber (124) and the primary chamber (110).

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An imaging media cartridge comprising:

a first imaging media reservoir chamber;

a second imaging media reservoir chamber; and a removable barrier disposed between the first imaging media reservoir chamber and the second imaging media reservoir chamber; and wherein:

the first imaging media reservoir chamber is defined by a first volume;

the second imaging media reservoir chamber is defined by a second volume; and the first and second imaging media reservoirs contain respective volumes of a mutually common composition of imaging media.

2. The imaging media cartridge of claim 1, and wherein the removable barrier comprises a strip of tape.

3. The imaging media cartridge of claim 2, and further comprising a pull tab attached to the strip of tape.

4. The imaging media cartridge of claim 1, and further comprising an imaging media passageway defined between the first imaging media reservoir chamber and the second imaging media reservoir chamber, and wherein the removable barrier comprises a rigid member configured to move from a first position wherein the removable barrier is disposed within the imaging media passageway to a second position wherein the removable barrier is not disposed within the imaging media passageway.

5. The imaging media cartridge of claim 4, and further comprising a thumb switch connected to the rigid member.

6. The imaging media cartridge of claim 1, and wherein the imaging media cartridge is a dry toner cartridge.

7. The imaging media cartridge of claim 1, and wherein the imaging media cartridge is liquid ink cartridge.

8. The imaging media cartridge of claim 1, and wherein the removable barrier is a second removable barrier, the imaging media cartridge further comprising:

a distribution chamber;

an imaging media distribution device configured to extract imaging media from the distribution chamber; and a first removable barrier disposed between the first imaging media reservoir chamber and the distribution chamber.

9. The imaging media cartridge of claim 8, and wherein the distribution device is an optical photoconductor.

10. The imaging media cartridge of claim 1, and further comprising a cartridge body which defines the first imaging media reservoir chamber and the second imaging media reservoir chamber.

11. An imaging media cartridge comprising:

a first imaging media reservoir chamber;

a second imaging media reservoir chamber; and a removable barrier disposed between the first imaging media reservoir chamber and the second imaging media reservoir chamber;

and wherein:

the first chamber contains a first volume of an imaging media of a predetermined composition;

the second chamber contains a second volume of the same imaging media as the imaging media contained in the first chamber; and the second volume of the imaging media is at least ten percent less than the first volume of the imaging media.

12. An imaging media cartridge comprising:

a first imaging media reservoir chamber;

a second imaging media reservoir chamber;

a distribution chamber;

an imaging media distribution device configured to extract imaging media from the distribution chamber;

a first removable barrier disposed immediately between the first imaging media reservoir chamber and the distribution chamber;

a second removable barrier disposed immediately between the distribution chamber and the second imaging media reservoir chamber; and wherein the first removable barrier and the second removable barrier are configured to be separately removable.

13. The imaging media cartridge of claim 12, and wherein:

the first imaging media reservoir chamber contains a first volume of imaging media;

the second imaging media reservoir chamber contains a second volume of imaging media; and the distribution chamber does not contain imaging media.

14. The imaging media cartridge of claim 13, and wherein the imaging media comprises a dry toner.

15. The imaging media cartridge of claim 14, and wherein the imaging media distribution device comprises an optical photoconductor.

16. A toner cartridge comprising:

a first toner reservoir chamber;

a second toner reservoir chamber;

a distribution chamber; and wherein:

the first toner reservoir chamber and the second toner reservoir chamber are configured to be in communication with one another via the distribution; and the first toner reservoir chamber and the second toner reservoir chamber contain respective volumes of a mutually common composition of toner.

17. The toner cartridge of claim 16, and further comprising a toner distribution device configured to extract toner from the distribution chamber.

18. A liquid ink cartridge, comprising:

a cartridge body;

a first bladder supported within the cartridge body and defining a first ink reservoir;

a second bladder supported within the cartridge body and defining a second ink reservoir; and a removable barrier disposed between the first and second bladders and configured such that when the removable barrier is in position between the bladders, the bladders are not in fluid communication, and when the removable is removed from between the bladders, the bladders are in fluid communication.

19. The liquid ink cartridge of claim 18, and further comprising a print head in fluid communication with the first bladder.

20. The liquid ink cartridge of claim 18, and wherein the removable barrier is defined by a first end protruding from the cartridge body and which defines a button, and wherein the button is biased away from the cartridge body by a compliant member.

21. An imaging media cartridge comprising:

a first imaging media reservoir chamber;

a second imaging media reservoir chamber;

an imaging media passageway defined between the first imaging media reservoir chamber and the second imaging media reservoir chamber;

a removable barrier disposed between the first imaging media reservoir chamber and the second imaging media reservoir chamber, wherein the removable barrier comprises a rigid member configured to move from a first position wherein the removable barrier is disposed within the imaging media passageway to a second position wherein the removable barrier is not disposed within the imaging media passageway; and a thumb switch connected to the rigid member;

and wherein:

the first imaging media reservoir chamber is defined by a first volume;

the second imaging media reservoir chamber is defined by a second volume; and the second volume is ten percent or less of the first volume.

22. The imaging media cartridge of claim 1, and wherein the second volume is ten percent or less of the first volume.

* * * * *

UNITED STATES PATENT AND TRADEMARK OFFICE

CERTIFICATE OF CORRECTION

PATENT NO. : 6,880,924 B2
APPLICATION NO. : 10/644481
DATED : April 19, 2005
INVENTOR(S) : Robert Sesek et al.

It is certified that error appears in the above-identified patent and that said Letters Patent is hereby corrected as shown below:

IN THE CLAIMS

Claim 16, Column 11, line 46, after “distribution” insert --chamber--

Signed and Sealed this

Twenty-sixth Day of June, 2007

JON W. DUDAS
*Director of the United States Patent and Trademark Office*